US010320043B2

(12) United States Patent
Chueh

(10) Patent No.: US 10,320,043 B2
(45) Date of Patent: Jun. 11, 2019

(54) POWER DISTRIBUTING DEVICE

(71) Applicant: NANNING FUGUI PRECISION INDUSTRIAL CO., LTD., Nanning (CN)

(72) Inventor: Yu-Chih Chueh, New Taipei (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 27 days.

(21) Appl. No.: 15/602,203

(22) Filed: May 23, 2017

(65) Prior Publication Data

US 2018/0342777 A1 Nov. 29, 2018

(51) Int. Cl.

| | |
|---|---|
| ***H01P 1/20*** | (2006.01) |
| ***H01P 3/08*** | (2006.01) |
| ***H01P 5/12*** | (2006.01) |
| ***H01P 1/203*** | (2006.01) |

(52) U.S. Cl.

CPC ..... *H01P 1/20* (2013.01); *H01P 1/20381* (2013.01); *H01P 3/081* (2013.01); *H01P 5/12* (2013.01)

(58) Field of Classification Search

CPC .... H01P 1/20; H01P 3/081; H01P 5/12; H01P 1/20381

USPC ..... 333/125–135

See application file for complete search history.

(56) References Cited

U.S. PATENT DOCUMENTS

| | | | | |
|---|---|---|---|---|
| 6,329,949 | B1 * | 12/2001 | Barnett | H01Q 1/246 333/202 |
| 2002/0008599 | A1 | 1/2002 | Sridharan | |
| 2016/0242113 | A1 * | 8/2016 | McIntyre | H04B 1/44 |

FOREIGN PATENT DOCUMENTS

| | | | |
|---|---|---|---|
| CN | 1780046 | A | 5/2006 |
| CN | 105006622 | A | 10/2015 |
| CN | 105375093 | A | 3/2016 |
| EP | 1347532 | A1 | 9/2003 |

* cited by examiner

*Primary Examiner* — Robert J Pascal
*Assistant Examiner* — Kimberly E Glenn
(74) *Attorney, Agent, or Firm* — ScienBiziP, P.C.

(57) ABSTRACT

A miniaturized power distributing device with harmonic suppression function and low cost is set in a substrate, and includes first, second, and third metal levels. The first metal level includes a power divider to divide one signal into multiple output signals, or to combine multiple input signals into one output signal. The second metal level includes a filter structure to filter out harmonics. The third metal level is isolated against electromagnetic wave signal leaking from the second metal level. The second metal level is set between the first and third metal levels, dielectric layers are set between the first and second metal levels and between the second and third metal levels.

12 Claims, 6 Drawing Sheets

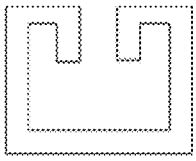
FIG. 6(a)
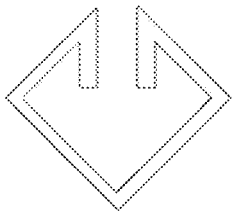
FIG. 6(b)
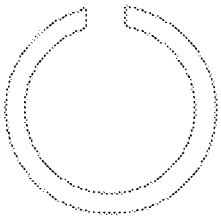
FIG. 6(c)
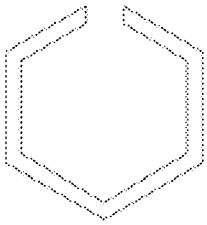
FIG. 6(d)
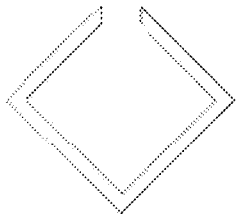
FIG. 6(e)
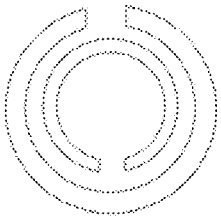
FIG. 6(f)
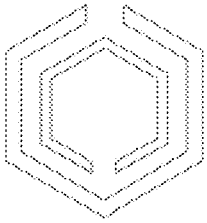
FIG. 6(g)
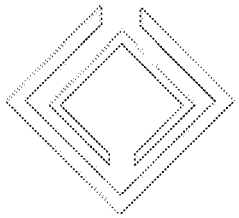
FIG. 6(h)
FIG. 6

POWER DISTRIBUTING DEVICE

FIELD

The subject matter herein generally belongs to power distributing field, especially relates to a multilayer and miniaturized power distributing device.

BACKGROUND

Power distributing device is a device that divides one input signal into two or multiple output signals, or is a device that combines two or more input signals into one output signal. Power distributing device is widely used in antenna array, balance power amplifier, mixer, phaser, and so on. Power distributing device contains 3 dB bridge coupler, branch-line bridge coupler, annular bride coupler, and Wilkinson power divider, and the most frequently-used power distributing device is the Wilkinson power divider. However, traditional Wilkinson power divider occupies a large area of printed circuit board (PCB) due to length of the Wilkinson power divider being fourth of the operation frequency. Furthermore, traditional Wilkinson power divider lacks harmonic suppression function. In order to suppress harmonics, filter is needed, and this largely increases the cost. Therefore, a miniaturized power distributing device with harmonic suppression function and low cost is needed.

BRIEF DESCRIPTION OF THE DRAWINGS

Exemplary embodiments of the present technology will now be described, by way of example only, with reference to the attached figures, wherein:

FIG. 6(*a*) FIG. 6(*h*) are structural diagrams of the filtering structure in other exemplary embodiments of the disclosure.

DETAILED DESCRIPTION

Figure 1:
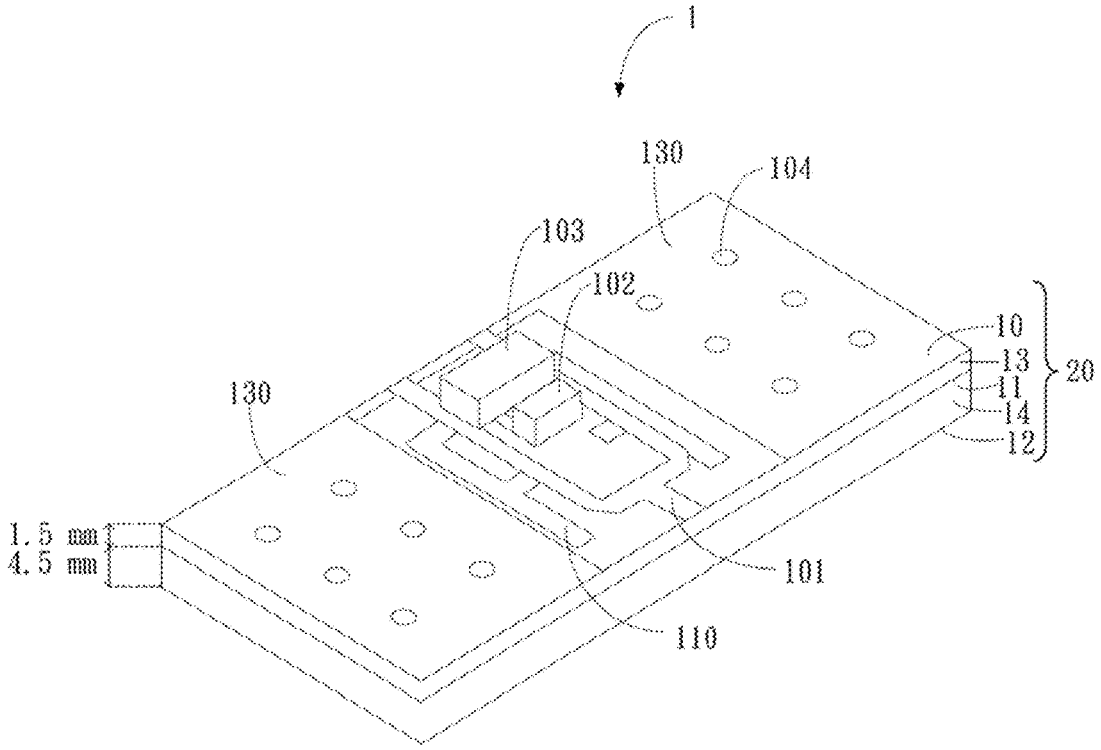
FIG. 1 is a structural diagram of a power distributing device according to an exemplary embodiment of the disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure. The disclosure is illustrated by way of example and not by way of limitation in the figures of the accompanying drawings in which like references indicate similar elements. It should be noted that references to "an" or "one" exemplary embodiment in this disclosure are not necessarily to the same exemplary embodiment, and such references mean at least one.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series, and the like.

FIG. 1 is a structural diagram of a power distributing device according to an exemplary embodiment of the disclosure.

In the exemplary embodiment, a power distributing device 1 is set in a substrate 20, and comprises a first metal level 10, a second metal level 11, and a third metal level 12. The first metal level 10, the second metal level 11, and the third metal level 12 are successively set in the substrate 20. The substrate 20 further comprises a first dielectric layer 13 set between the first metal level 10 and the second metal level 11, and a second dielectric layer 14 set between the second metal level 11 and the third metal level 12.

In one exemplary embodiment, the first metal level 10 comprises a power divider 101, both sides of the power divider 101 are in a first metal structure 130. The power divider 101 is configured to divide one signal into multiple output signals, or to combine multiple input signals into one output signal. Hereinafter, "multiple" means at least two. Power divider 101 can be constructed by transmission line, for example, the transmission line can be a microstrip line. The power divider 101 comprises a combining port and two dividing ports. In one exemplary embodiment, the two dividing ports are equal-power output ports. It should be understood, in other exemplary embodiments, power divider 101 can have more than two dividing ports, and the dividing ports can be equal-power output ports or otherwise, the dividing ports can each be a different and specific power output port.

In one exemplary embodiment, the first metal level 10 further comprises a matching capacitor 103 and an isolation resistor 102. The isolation resistor 102 is configured to increase isolation between the two dividing ports. The matching capacitor 103 is configured to adjust working frequency of the power divider 101 to promote best isolation between the two dividing ports.

In one exemplary embodiment, the second metal level 11 comprises a filter structure 110. Both sides of the filter structure 110 are in a second metal structure (not shown in FIG. 1), and the second metal structure is correspondingly located under the first metal structure 130. The filter structure 110 is configured to couple with the first metal level 10 to filter out harmonics in the power distributing device 1, for example, the harmonics can be second order or higher harmonics. In one exemplary embodiment, the filter structure 110 is coupled with the power divider 101 to filter harmonics in the power distributing device 1. In one exemplary embodiment, the filter structure 110 can be a slot structure.

In one exemplary embodiment, the third metal level 12 can be metal, configured to isolate electromagnetic wave signals leaking from the second metal level 11, to avoid interference with other devices or elements. The second metal level 11 is set between the first metal level 10 and the third metal level 12. The first dielectric layer 13 and the second dielectric layer 14 can be dielectric. A thickness of the first dielectric layer 13 can be 0.15 mm and a thickness of the second dielectric layer 14 can be 0.45 mm. The permittivity of the first dielectric layer 13 and the permittivity of the second dielectric layer 14 can be 4.4, and their dielectric loss can be 0.02. Dielectric material of the first dielectric layer 13 and the second dielectric layer 14 can be FR4. In other exemplary embodiments, materials and thicknesses of the first dielectric layer 13 and the second dielectric layer 14 can be chosen according to need.

In one exemplary embodiment, power distributing device 1 further comprises a plurality of metal via-holes 104. The third metal level 12 is coupled to the first metal structure 130 of the first metal level 10 and the second metal structure of the second metal level 11 through the metal via-holes 104. The metal via-holes 104 are configured to increase grounding effect and to couple signals from the first metal level 10 and the second metal level 11. Quantity of the metal via-holes 104 can be 16, and these can be set symmetrically in both sides of the power distributing device 1. In other exemplary embodiments, the quantity of the metal via-holes 104 can be chosen as needed.

In one exemplary embodiment, a length and width of the power distributing device 1 can be 2.4 mm and 2 mm, respectively. In other exemplary embodiments, the length and width of the power distributing device 1 can be chosen as needed.

Figure 2:
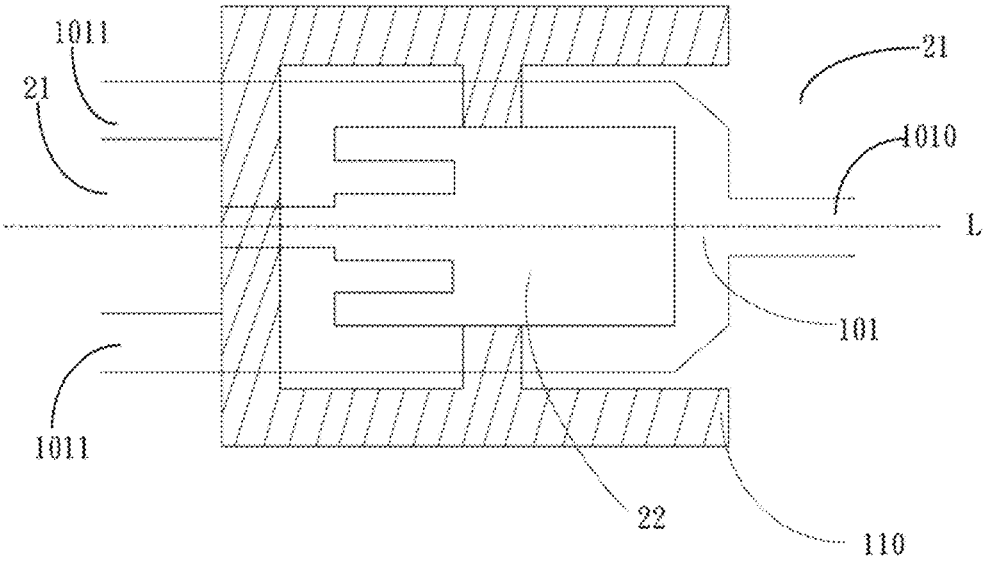
FIG. 2 is a top planar view of a first metal level at a second metal level in the power distributing device of FIG. 1.

FIG. 2 is a top planar view of a first metal level at a second metal level in the power distributing device of FIG. 1.

In one exemplary embodiment, power divider 101 projection at the second metal level 11 partly overlaps with the filter structure 110. The combining port (1010) and the two dividing ports (1011, 1012) of the power divider 101 projection extend to external space 21 of the filter structure 110, and the remaining part of the power divider 101 projection is located in inner space 22 of the filter structure 110. The power divider 101 projection in the second metal level 11 and the filter structure 110 are symmetrical by the mid-perpendicular line 'L'.

Figure 3:
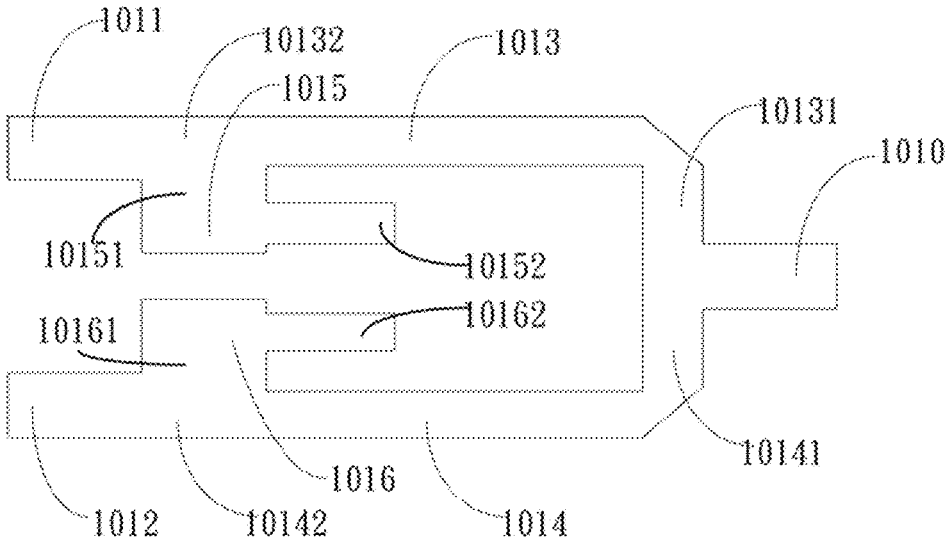
FIG. 3 is a structural diagram of a power divider in the power distributing device of FIG. 1.

FIG. 3 is a structural diagram of the power divider 101 in the power distributing device 1 of FIG. 1.

In one exemplary embodiment, the power divider 101 comprises a first port 1010, a second port 1011, and a third port 1012. The first port 1010 can be the combining port, and the second port 1011 and the third port 1012 can be the two dividing ports. The power divider 101 further comprises a first transmission line 1013, a second transmission line 1014, a third transmission line 1015, and a fourth transmission line 1016. The first transmission line 1013 can be L-shaped, with a first short end 10131 coupled to the first port 1010 and a first long end 10132 coupled to the second port 1011. The second transmission line 1014 can be L-shaped, with a second short end 10141 coupled to the first port 1010 and a second long end 10142 coupled to the third port 1012. The third transmission line 1015 can be L-shaped, with a third short end 10151 coupled to the first long end 10132, and a third long end 10152 extending to the first short end 10131. The fourth transmission line 1016 can be L-shaped, with a fourth short and 10161 coupled to the second long end 10142, and a fourth long and 10162 extending to the second short end 10141.

In one exemplary embodiment, the transmission line can be a microstrip line.

As shown in FIG. 1 and FIG. 3, in one exemplary embodiment, the matching capacitor 103 is coupled to the third long end and the fourth long end. The isolation resistor 102 is coupled to the third short end and the fourth short end.

Figure 4:
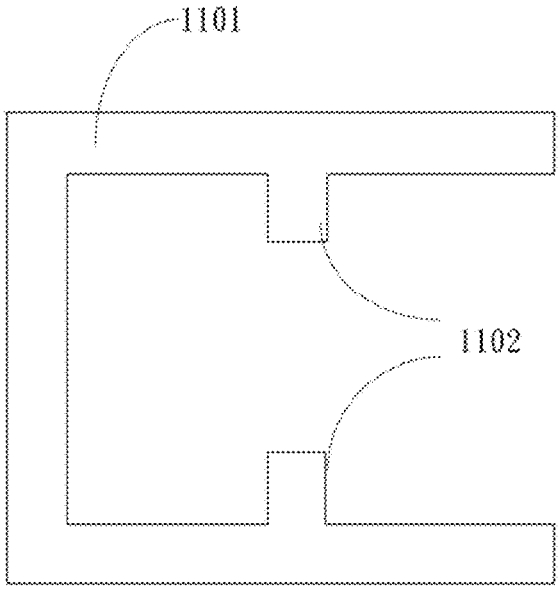
FIG. 4 is a structural diagram of a filtering structure in the power distributing device of FIG. 1.

FIG. 4 is a structural diagram of a filtering structure in the power distributing device of FIG. 1.

In one exemplary embodiment, the filter structure 110 can be a slot structure, comprising a U-shaped slot 1101. The U-shaped slot 1101 has a bottom portion and a pair of side portions on opposite sides of the bottom portion, and the bottom side is coupled to the opposite sides. The U-shaped slot 1101 comprises an opening. The opposite sides further comprise a strip slot 1102. In other exemplary embodiments, the slot structure can be selected from other shapes and designs, such as unfilled corner square, unfilled corner hexagon, and so on.

As shown in FIG. 1 and FIG. 2, in one exemplary embodiment, the opening of the U-shaped slot 1101 is orientated toward the first port 1010. The strip slot 1102 does not extend out of the projection of the first transmission line 1013 and the second transmission line 1014.

Figure 5:
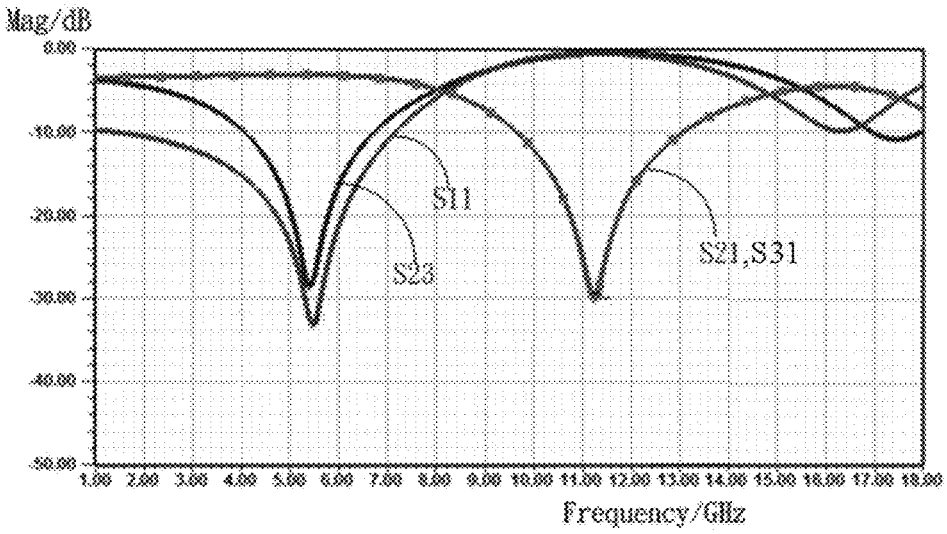
FIG. 5 is an S parameter simulation diagram of an exemplary embodiment of the power distributing device of FIG. 1.

FIG. 5 is an S parameter simulation diagram of an exemplary embodiment of the power distributing device 1.

In one exemplary embodiment, when the power distributing device 1 operates at 5.50 GHz, the second port 1011 and the third port 1012 are isolated. S23 parameter is less than −20 dB at 5.5 GHz, and S11 parameter is less than −30 dB at 5.5 GHz. The two dividing ports can be equal-power output ports, and S21, S31 parameters is −3 dB when under 6.00 GHz.

FIG. 6 is structural diagram of the filtering structure in other exemplary embodiments of the disclosure.

In various exemplary embodiments, the filter structure 110 can be shapes as shown in FIG. 6(*a*)~FIG. 6(*h*). In other exemplary embodiments, the filter structure 110 can be other shapes.

The foregoing description, for purposes of explanation, has been described with reference to specific exemplary embodiments. However, the discussion above is not intended to be exhaustive or to limit the disclosure to the precise forms disclosed. Many modifications and variations are possible in view of the above teachings. The various modifications from the principles of the disclosure are therefore included and protected within the scope of the claims.

What is claimed is:

1. A power distributing device, set in a substrate, comprising:

a first metal level, comprising a power divider configured to divide one signal to multi output signals, or to combine multi input signals into one output signal, wherein the power divider comprises:

a first port, a second port and a third port, the first port is a combining port, and the second port and the third port are two dividing ports;

a first transmission line, which is L-shaped with a first short end coupled to the first port, and a first long end coupled to the second port;

a second transmission line, which is L-shaped with a second short end coupled to the first port, and a second long end coupled to the third port;

a third transmission line, which is L-shaped with a third short end coupled to the first long end, and a third long end extending to the first short end; and a fourth transmission line, which is L-shaped with a fourth short end coupled to the second long end, and a fourth long end extending to the second short end;

a second metal level, comprising a filter structure configured to filter harmonics by coupling to the power divider; and a third metal level, configured to isolate electromagnetic wave signal leaked from the second metal level;

wherein the second metal level is set between the first metal level and the third metal level, a first dielectric layer is set between the first metal level and the second metal level, and a second dielectric layer is set between the second metal level and the third metal level.

2. The power distributing device of claim 1, wherein the power divider is a microstrip line structure.

3. The power distributing device of claim 1, wherein the first metal level further comprises a matching capacitor coupled to the third long end and the fourth long end, and configured to adjust working frequencies of the power divider.

4. The power distributing device of claim 3, wherein the first metal level further comprises an isolation resistor coupled to the third short end and the fourth short end, and configured to increase the isolation between the two dividing ports.

5. The power distributing device of claim 4, wherein the filter structure is a slot structure.

6. The power distributing device of claim 5, wherein the slot structure comprises an U-shaped slot with a bottom portion and a pair of side portions on opposite sides of the bottom portion, and an U-shaped slot opening orientated towards the first port.

7. The power distributing device of claim 6, wherein the slot structure comprises a strip slot, the strip slot does not extend out of the projection of the first transmission line and the second transmission line.

8. The power distributing device of claim 7, wherein power divider projection in the second metal level and the filter structure are symmetrical by a mid-perpendicular line.

9. The power distributing device of claim 1, wherein a length of the power distributing device is about 2.3 mm, and a width of the power distributing device is about 2 mm.

10. The power distributing device of claim 1, further comprising a plurality of metal via-holes, wherein the plurality of metal via-holes is electrically coupled to the first metal level, the second metal level and the third metal level.

11. The power distributing device of claim 10, wherein the plurality of metal via-holes are symmetrically arranged at both sides of the power divider.

12. The power distributing device of claim 1, wherein a thickness of the first dielectric layer is about 0.15 mm, and a thickness of the second dielectric layer is about 0.45 mm.

* * * * *